United States Patent [19]

Kelly

[11] Patent Number: 4,784,107

[45] Date of Patent: Nov. 15, 1988

[54] BALL PITCHING SYSTEM

[76] Inventor: Eddy D. Kelly, Rte. 3, Box 736, Rockwall, Tex. 75087

[21] Appl. No.: 936,398

[22] Filed: Dec. 1, 1986

[51] Int. Cl.[4] ..... F41B 11/00

[52] U.S. Cl. ..... 124/61; 124/7; 124/48; 124/50; 124/77; 92/134

[58] Field of Search ..... 124/6, 7, 9, 50, 60, 124/61, 73, 77; 92/134

[56] References Cited

U.S. PATENT DOCUMENTS

| | | | |
|---|---|---|---|
| 3,345,977 | 10/1967 | Hall | 124/77 |
| 3,467,073 | 9/1969 | Rhodes | 124/48 |
| 3,738,662 | 6/1973 | Hodgin | 124/50 |
| 3,989,027 | 11/1976 | Kahelin | 124/77 |
| 4,004,567 | 1/1977 | Henderson | 124/61 |
| 4,269,162 | 5/1981 | Abraham et al. | 124/7 |

*Primary Examiner*—Robert A. Hafer

*Assistant Examiner*—Charles H. Sam

*Attorney, Agent, or Firm*—Stanley R. Moore; Thomas L. Crisman

[57] ABSTRACT

A ball pitching system comprising a pneumatically actuated pitching arm and automatic ball feed system. The pneumatic actuation is provided by an automatic pressure sensor valve. Compressed air is provided by a DC compressor affixed to the frame of the pitching apparatus and may be powered by a conventional 12 volt vehicular battery system. In this manner the preselect pitching of baseballs and the like along a predefined trajectory can be provided at remote locations away from conventional power sources by using conventional automotive electrical supply. The system further provides a reliable, inexpensive assemblage require little maintenance and maximum enjoyment of use with baseballs and the like.

9 Claims, 3 Drawing Sheets

BALL PITCHING SYSTEM

BACKGROUND OF THE INVENTION

1. Field of the Invention

The present invention relates to automatic systems for throwing a ball along a predefined trajectory, and , more particularly, to a portable baseball pitching machine utilizing a pivotal pitching arm configuration.

2. History of the Prior Art

The prior art is replete with ball throwing systems, for use in the practice of hitting balls, such as baseballs and the like. An important criteria of such throwing apparatus is the type of trajectory afforded by the system and the ability of the system to duplicate a particular trajectory time after time. It is also important for the system to be both reliable and easy to use by the operator. With such systems, a single individual can practice sports such as baseball and tennis without the involvement of other people. Batting and related swing techniques can be practiced repeatedly for improving actual game performance.

Baseball pitching machines are quite old. The prior art has a number of such machines dating back many decades due, in part, to the fact that baseball itself goes back many years. Batting is well known to be an endeavor for which batting practice is important. Machines which repeatedly pitch a ball along a predefined trajectory are thus critical to proper batting practice. Most conventional batting machines are, however, adapted for a single location where AC electric power can be used and wherein the size of the machine is not critical due to the fact that portability is not a consideration. Not all batting practice is on a level for which expensive commercial batting systems are affordable. Indeed, many conventional softball activities are played in remote areas by individuals in informal groups. Such individuals would obviously need batting practice more than professionals to make the game more enjoyable. For this reason portable batting machines have received widespread acceptance and are known to be very useful. One distinct problem is the absence of 120V power at such remote locations a unlighted baseball diamonds and open fields.

Various prior art embodiments of ball pitching systems are set forth and shown in a number of issued U.S. Pat. Nos. For example, U.S. Pat. No. 1,190,565 is a 1916 patent issued to J. D. Long for mechanical baseball pitcher. The device shown therein utilizes a throwing arm which mechanically pivots about a central axis to hurl a ball along a predefined trajectory. Also taught are means for guiding a ball and changing the angle of delivery thereof as well delivering the balls one at a time to the throwing member or arm. It may thus be seen that the basic concept of ball pitching systems utilizing a pitching arm configuration is quite basic in the prior art. The manner in which such systems operate as well as the manner in which said systems are powered have received a great deal of attention over the last seven decades. For example, U.S. Pat. No. 1,825,882 issued to W. C. Mauney in 1931 shows a ball throwing machine utilizing a chain drive. The chain drive is adapted to be operated by the falling of a weight to operate the throwing arm. An electric motor is utilized to raise the weight and thus this patent teaches the incorporation of electric power for providing a pitching system.

Due to the inherent problems of electric powered ball throwing machines, the utilization of manual systems retained its viability for many years. For example, U.S. Pat. No. 2,080,958 issued to M. Beasley et al. in 1937 shows a practice machine incorporating an elastic tether. The speed at which the ball may be thrown is said to be regulated by the amount of swing produced upon the arm as well as the strength of the tension band secured thereto. The utilization of tension or "spring" actuated pitching machines has also found very recent acceptance. U.S. Pat. No. 4,082,076 issued to Perry for a spring type ball pitching apparatus clearly teaches the benefits of a portable ball pitching system. The system taught therein alleviates the problem of electrical power by providing for manual loading and spring actuation. The problems of the prior art are clearly addressed therein and includes the complexity and expense of many prior art structures. A baseball pitching apparatus which can be manipulated by a batter with no assistance from anyone else is said to be clearly desirable as is quite clearly manifest by most recent developments in the prior art. Simplicity and dependability in operation are very important aspects. However, such manual systems themselves have inherent problems due the fact that manual loading is not always feasible for an individual seeking batting practice at a remote location by himself. It is inconvenient and not conducive to routine practice to require constant reloading of ball pitching systems. For this reason automated systems such as that set forth in U.S. Pat. No. 4,262,648 issued to Wegener et al. in 1981 have been provided. Reliability can be afforded through such electrically powered systems, but again the aspect of portability and power requirements at remote locations is a major consideration.

The aforesaid problems and approaches to the prior art are not simply limited to baseball systems. U.S. Pat. No. 1,273,301 issued to Abraham Wood is a 1918 reference for apparatus used in throwing an object other than a baseball. In this particular embodiment a grenade is the object of interest and the system is adapted for use in warfare. The principle of the accurate arm movement is, however, taught and manifested the prior art utilization of such pitching motions. More conventional systems for objects other than baseballs have utilized electric power, as set forth above, such as that set forth in U.S. Pat. No. 4,269,162 issued to Abraham et al. and U.S. Pat. No. 4,207,857 issued to Balka. These more recent patents teach ball pitching and serving systems utilizing electrical power to provide versatility in both pitching trajectories, pitching distance and the types of balls which may be used. However, the simplicity and economics of a portable system which can be made available to an individual for "hobby" batting practice still remains a consideration in such ball pitching system designs.

It would be an advantage therefore to overcome the disadvantages of the prior art by providing a ball pitching system that is both portable and effective in the pitching operation for an individual. Such a system must be reliable, lightweight, portable and self-contained for use by an individual at a remote location. The present invention provides such a system by the utilization of a DC power air compressor and a pneumatic pitching system. In this manner softballs may be hurled along a predefined trajectory with a pivotal arm actuated by compressed air. The system is constructed to derive its power from conventional DC power sources available at remote locations such as the 12 volt electric power system of a conventional automobile. By tapping this 12 volt power system, the present invention affords the advantages of a ball throwing mechanism which overcomes the disadvantages of the prior art in a reliable and cost effective manner.

SUMMARY OF THE INVENTION

The present invention relates to ball pitching systems incorporating a pitching arm and pneumatic actuation therefor. More particularly, one aspect of the invention comprises an improved system for throwing balls along a predefined trajectory of the type wherein an arm is pivoted upwardly for pitching a ball positioned thereon. The improvement comprises a frame adapted for positioning upon a support surface and having a pitching arm pivotally mounted thereto. Means are securable to the frame for supplying compressed air. A pneumatic cylinder is coupled at a first end to the arm and at a second end to the frame. Means couple the compressed air means to the pneumatic cylinder. A ball chute is disposed adjacent one end of the pitching arm. Means are provided for retaining and discharging balls from the ball chute. Means are also incorporated for selectively actuating the pneumatic cylinder for hurling the balls positioned upon the pivotal arm by the pivotal actuation thereof in response to compressed air within the pneumatic cylinder.

In another aspect, the pitching system described above includes actuation means comprising a pop off valve and pressure fluid valve. The pop off valve is adapted for discharging compressed air for actuating the pressure fluid valve in release of the compressed air into the pneumatic cylinder. The ball chute comprises a cylindrical tube mounted to the frame and having a lower end disposed adjacent an upper end of the pivotal arm. The means for supplying compressed air includes a compressor mounted to the frame and the compressor is powered by a 12 volt DC current. It further includes a power cord having at least one end adapted for electrical connection with an automotive vehicle.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1:
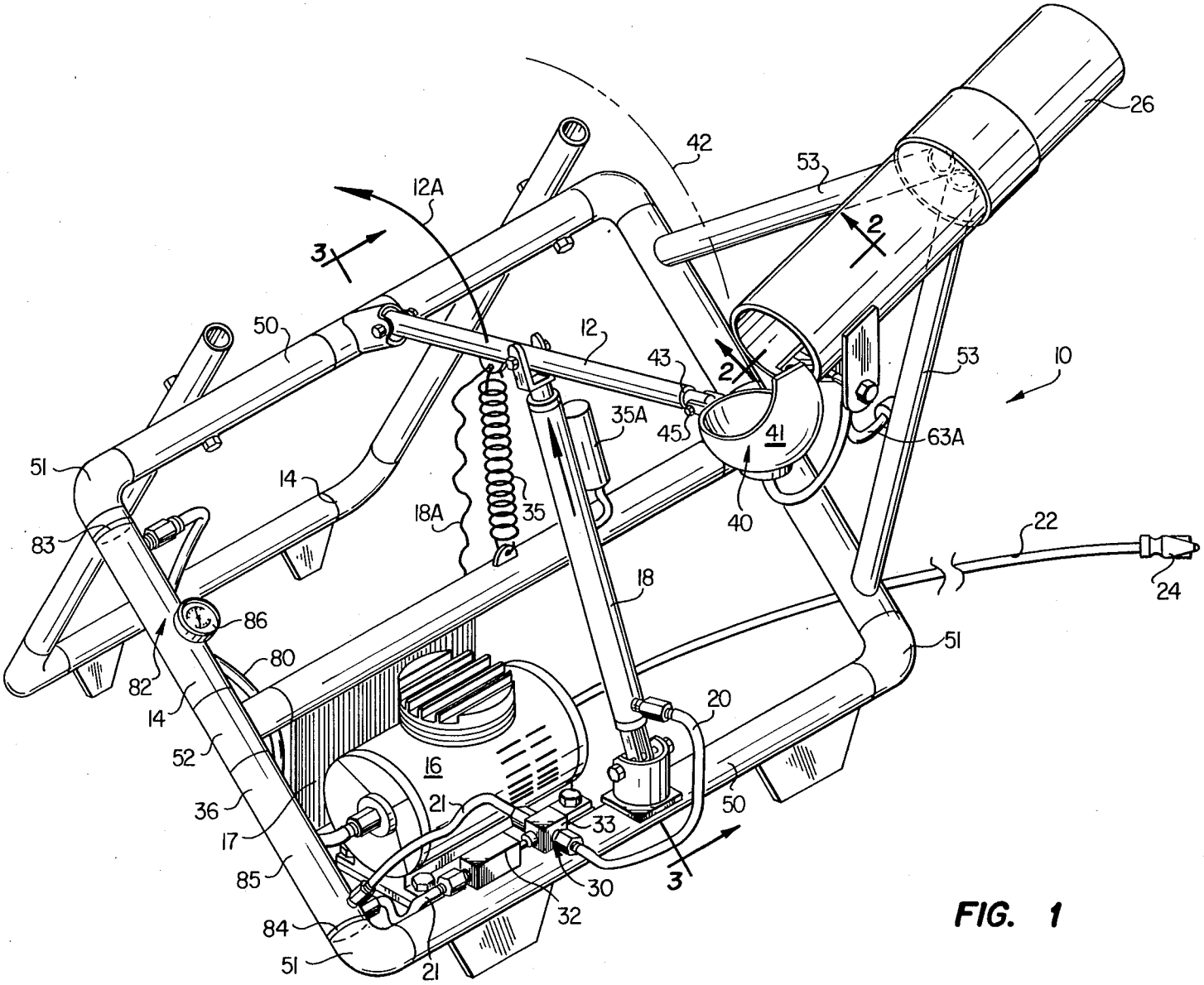
FIG. 1 is a perspective view of one embodiment of a ball pitching system constructed in accordance with the principles of the present invention.

Referring first to FIG. 1, there is shown a perspective view of one embodiment of a pitching system constructed in accordance with the principles of the present invention. The system 10 comprises a ball pitching arm 12 pivotally mounted within a hollow, lightweight frame 14. Mounted on the frame 14 is a compressor 16. The compressor 16 is coupled to a pneumatic cylinder 18 by flexible conduit member or hose 20 and secured to frame 14 by a shelf 17. The compressor 16 is powered by an electric cord 22 having a conventional DC 12 volt connector 24 affixed to the end thereof. Connector 24 is of the type conventionally used for automotive cigarette lighters (not shown) for tapping the 12 volt battery system of the automobile. In this manner, the system 10 can pitch baseballs 25 (shown in FIGS. 2–4) dispensed from chute 26 along predefined trajectory 42 (also shown in FIG. 4). The system 10 is actuated by an automatic trigger mechanism 30, responsive to select compressed air pressure levels. The trigger 30 includes an air pressure pop-off valve 32 which is coupled to flow, trigger valve 33 which is disposed in flow communication with storage reservoir 36. When the compressor pressure in reservoir 36 reaches a select level, the valve 32 actuates valve 33 and the cylinder 18. A tether 18A, or similar "stop" device, limits the travel of arm 12. A person taking batting practice can then be positioned at the end of the pre-established trajectory of the balls 25. After each actuation of the pitching arm 12 it is returned by spring 35, and/or return compression reservoir 35A, to the "cocked" position where the chute 26 discharges another ball 25 onto the pitching arm 12. The pitching arm 12 is then in position to automatically catapult the ball 25 after sufficient pressure as has built up in the reservoir via the trigger valves 32 and 33. This requires no attention of the batters who can concentrate solely on the endeavor of batting correctly.

The present system 10 is shown to utilize a conventional pressure "pop off" valve 32 disposed at the end of a "built-in" storage reservoir 36. The hollow frame 14 construction allows the "built-in" reservoir. The pop off valve 32 is coupled to the trigger valve 33 which discharges the pressure from the compression reservoir 36 once sufficient pressure has built up. Conventional air lines 21—21 are shown connecting the valves 30 and 32 to the reservoir 36. Thus the pressure is allowed to accumulate in reservoir 36 from the compressor 16 during which time the batter can prepare to hit another ball 25. It is because of the need for this delay between pitches that the smaller 12 volt compressor 16 can be used. This maximizes the effectiveness of design, eliminates the need for a high volume compressor and reduces the power consumption of the compressors so that it may be used with a conventional automotive battery system in remote areas.

Still referring to FIG. 1 the actuation of the pneumatic cylinder 18 causes the pitching arm 12 to pivot upwardly in direction of arrow 12A with the ball 25 disposed on the upper end 40 thereof. The accurate pitching or catapulting motion in direction 12A hurls the ball 25 along a predefined trajectory 42. The manner of construction of the pneumatic cylinder 18 and of the ball feed chute 26 is greatly simplified and fabricated from inexpensive materials due to the type of actuation provided herein. In this manner the system 10 can be constructed in an economical configuration and in a manner which affords reliability in use and a lightweight assemblage.

One embodiment of the system 10 of the present invention incorporates the utilization of PVC tubular members 50 assembled one to the other with conventional elbows 51 and "T-" coupling joints 52. The hollow PVC construction is both low in cost and structurally sound. For example, hollow members 53—53 support the chute 26. It is lightweight and the material is adapted for exposure to wind, rain and dirt. The material is easily cleaned and inherently safer than metal which can rust and cause cuts. The pneumatic actuation cylinder 18, likewise, can be fabricated from such material, simplifying the overall construction and limiting the number of expensive parts which must be purchased. Because a pneumatic system is being utilized, close tolerances are not a problem and the system is capable of withstanding infiltration of dirt and water without serious deleterious effects. Sandlot baseball and the like typically includes dusty areas, and therefore the system 10 of the present invention is particularly adapted for the individual having a desire to practice "solo" hitting of softballs and the like with such a batting system.

Figure 2A:
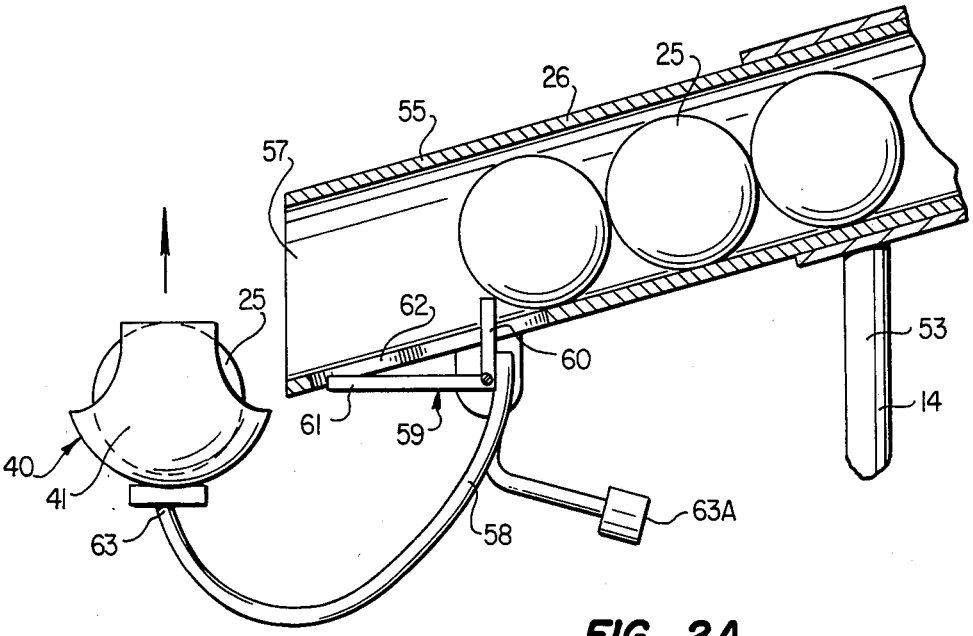
FIGS. 2(A) and 2(B) are enlarged, side-elevational, cross-sectional views of the ball feed chute of FIG. 1, taken along lines 2—2 thereof, illustrating the discharge of individual balls therefrom.

Referring now to FIG. 2 there are shown the two steps in the release of a ball 25 from the chute 26. FIG. 2A illustrates the positioning of a plurality of softballs 25 within a tubular structure 55 comprising the chute 26. A round, hollow region 57 is adapted for retaining the balls 25 therein through a release trigger 58 disposed therebeneath. Release trigger 58 comprises a generally L-shaped trigger arm 59 having a first release arm 60 formed generally orthogonal to a retainer arm 61. The release arm 60 engages the frontal ball 25 within the chute 26 during the release of a ball through the hollow region 57 thereof. In this position the retainer arm 61 has pivoted through a slotted region 62 formed in the sidewall of the tube 55 to permit clearance of the ball 25 thereacross. The ball 25 of this particular view is shown resting within the distal end 40 of the pitching arm 12. In this position the spring 35 will be shown to be substantially unexpanded and the tether 18A in a loose condition (FIG. 3A). Movement of the ball trigger is provided by an actuation arm 63 presented in a curved configuration which engages the lowermost region of the distal end 40 of the pivot arm. A counterweight 63A is provided for a balancing return forces. In this view the tube 55 of the chute 26 is shown secured by the brace 53 of the frame 14 described above. Although other ball release mechanisms could be incorporated within the spirit and scope of the present invention the present release trigger is consistant with the simplicity of the operation of the present invention and affords a reliable mechanism for release of single balls from the chute 26.

Figure 2B:
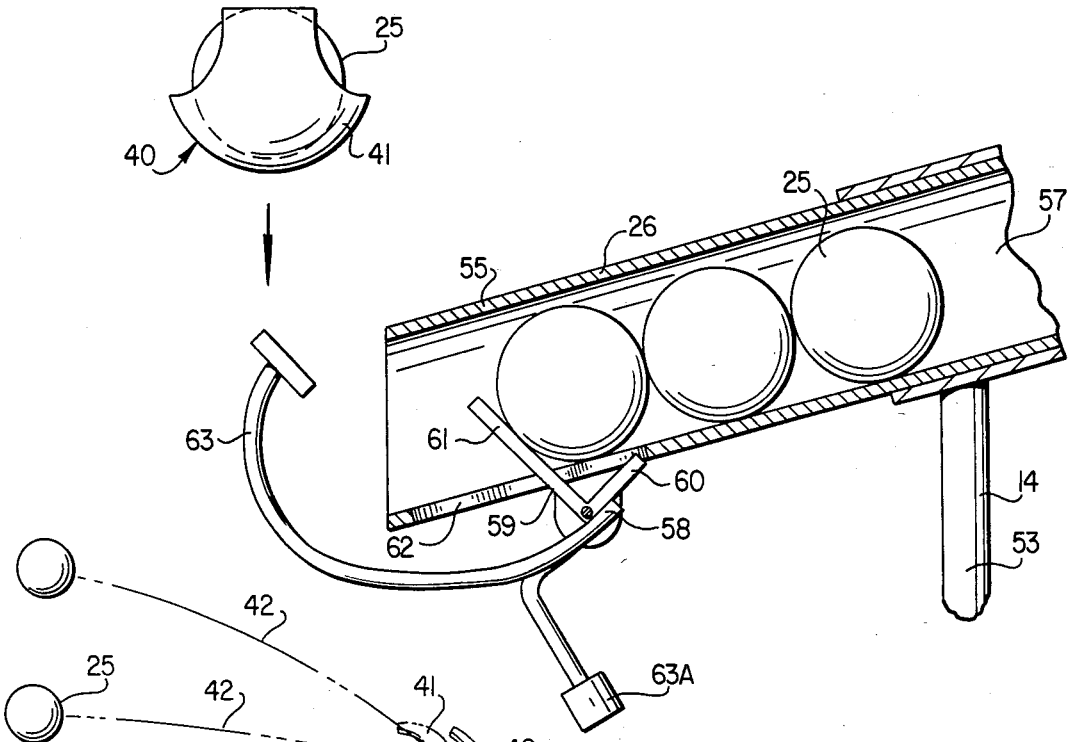
Figure 3A:
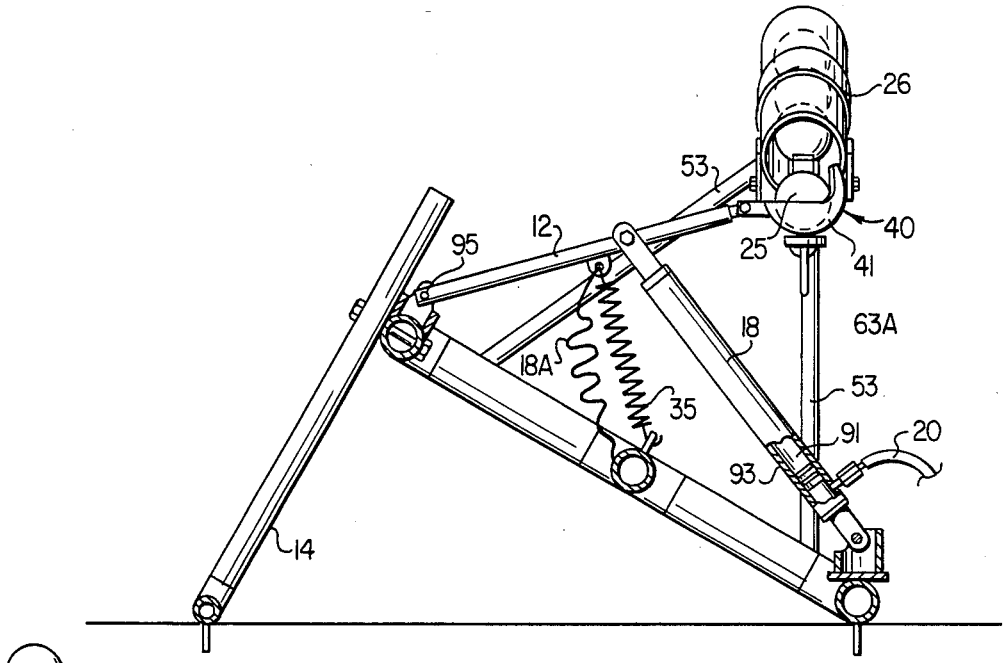
FIGS. 3(A) and 3(B) are side-elevational cross-sectional views of the apparatus of FIG. 1 taken along lines 3—3 thereof illustrating the actuation of the pitching arm and the throwing of a ball therefrom.
Figure 3B:
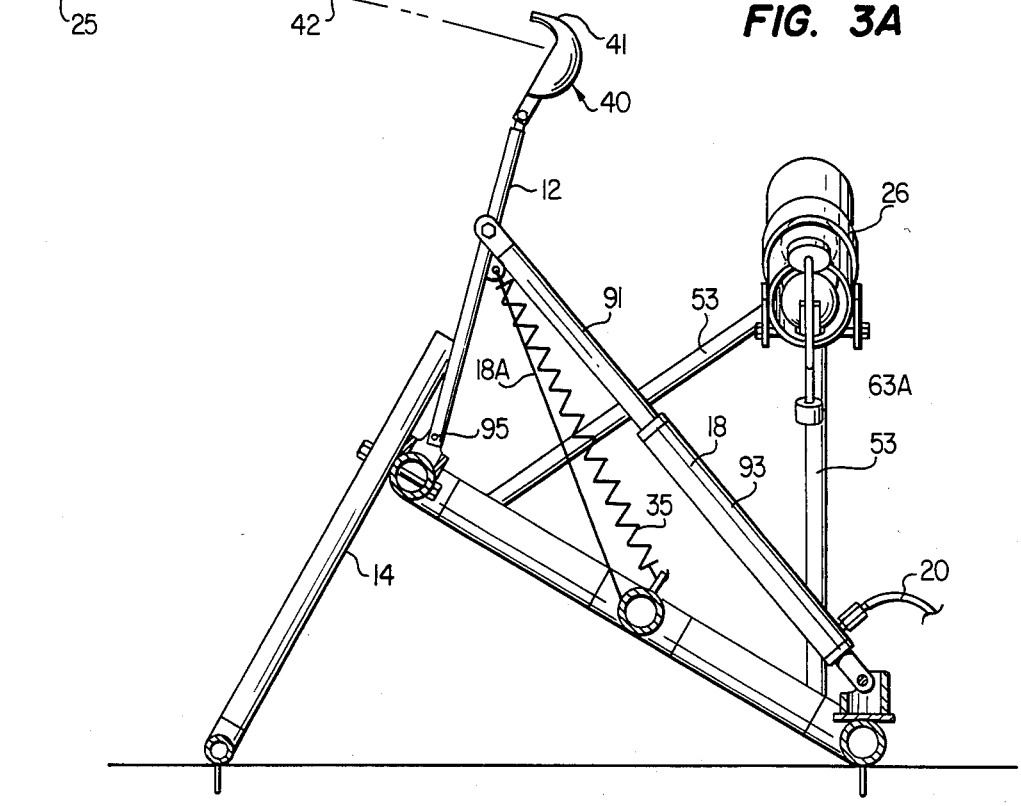

Referring now to FIG. 2B there is shown the ball release trigger 58 of FIG. 2A in a second position with the distal end 40 of the pivot arm moved upwardly therefrom which occurs during the pitching operation described herein. In this particular configuration, the retainer arm has pivoted upwardly with the actuation arm due to the release of the distal end 40 therefrom. In this position the tether 18A will be seen to be taught in restraint of the arm 12 (FIG. 3B). The upward pivotal movement of the retainer arm has recessed the release arm through the slot 62 to allow the advance of the next ball 25 against the retainer arm 61. The angular configuration and size of the release and retainer arm 60 and 61, respectively, are such to permit the positioning of a single ball 25 therebetween during each pivotal actuation of the ball trigger 58. The downward, return motion of the distal end 40 of the pivot arm 12 from spring 35, and/or return compression reservoir 35A, will depress the actuation arm 63 to preposition the release arm as shown in FIG. 2A and the ball 25 onto the distal end 40 of the pivot arm. The counterweight 63A has, of course, returned the arm 63 to the proper position. All of this movement is provided by the pneumatic actuation of the pivot arm 12 and the return spring 35 and/or compression reservoir 35A described herein. The size and spacing of the trigger mechanism 58 could obviously be modified for utilization with other ball sizes such as hardballs or tennis balls in accordance with the principles of the present invention.

Referring now to FIG. 3 there are shown the two, side-elevational, fragmentary, cross-sectional views of the system 10 of the present invention illustrating the two positional modes of the pitching arm 12 of FIGS. 2A and 2B. FIG. 3A thus corresponds to FIG. 2A wherein the ball 25 is positioned upon the distal end 40 of the pitching arm 12 with the system 10 in the preparatory mode for firing, or throwing the ball 25 along the predefined trajectory 42. As shown in FIG. 3A, the chute 26 has discharged the ball 25 onto a cup-shape member 41 disposed at distal end 40 of pitching arm 12. The remaining balls are retained within the chute 26 for subsequent release. Retaining spring 35 holds pitching arm 12 in its down, loading position during which time the ball 25 is allowed to come to rest within cup member 41 and compressed air is accumulated within the reservoir 36 defined by chamber area 85 of the frame 14. In this view the frame 14 is shown structurally securing the pivotal actuation members in preparation for actuation and pitching of the ball 25. A fragmentary, cross-sectional view of the actuation piston 18 is likewise shown wherein a piston member 91 is illustrated to be slidably received within cylinder member 93 with pneumatic hose 20 coupled thereto. Discharge of compressed air into the cylinder 93 thus drives the piston 91 upwardly causing the arm 12 to pivot about pivot point 95 as described in more detail below. The tether 18A is shown in a "relaxed" position.

Referring now to FIG. 3B there is shown the cross-sectional view of the pitching system 10 of FIG. 3A in the actuated or, fired mode. The ball 25 has thus been hurled along trajectory 42 by the expansion of the piston 91 from the cylinder 93. Pitching arm 12 is illustrated to be in an upright position with return spring 35 shown expanded and applying a downwardly biasing force thereto. The tether 18A restrains the arm 12 against further motion and spring 35 is provided for the return force. As discussed above, a compression return chamber **35*a* can be provided with, or in replace of, the spring 35 whereby air is compressed during the extension of arm 12 and used to return the arm 12 to its "rest" position. Such a structure would require a double acting cylinder 18, which is of conventional design in the pneumatic art. In this position air has been discharged through the conduit 20 to cause expansion within the cylinder 93. After firing, the air bleeds slowly therefrom, in a conventional manner such as around piston 91, as return spring 35 and/or chamber 35A urges the pitching arm 12 downwardly into the rest mode of FIG. 3A**.

Figure 4:
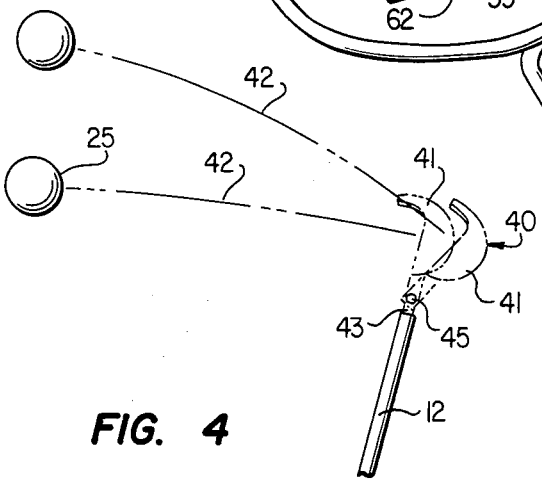
FIG. 4 is an enlarged, fragmentary, side-elevational view of the pitching arm illustrating one embodiment of a pitching adjustment mechanism of the present invention.

Referring now to FIG. 4 there is shown an enlarged, side-elevational, fragmentary view of the pitching arm 12 and the distal end 40 thereof comprising the ball support mechanism of the present invention. The ball support region comprises, in this particular embodiment a contoured cup-shape member 41 which is pivotally mounted to an end 43 of the pitching arm 12. The end 43 may include a threaded fastener 45 or the like adapted for loosening or tightening the cup member 41 relative to the pitching arm 12 for allowing repositioning thereof as shown in the drawings. Variation in the pivotal relationship of the cup 41 and arm 12 produces select changes in the pitching angles of the system 10. Two trajectories 42 are shown in FIG. 4. It can be seen that both the distance and the "type" of pitch can thus be varied to suit the particular needs of the batter using the apparatus 10.

In operation, the pitching system 10 of the present invention is capable of throwing a ball 25 along a predefined trajectory 42 utilizing conventional 12 volt DC power of the type generally found in automotive vehicles. As described above, the system 10 utilizes a basic pivotal pitching arm configuration with a design that fully utilizes the potential of such a configuration to adapt to the needs of a user at remote locations. The system 10 is both lightweight in construction and incorporates an assemblage that is reliable and inexpensive to manufacture. For example, the utilization of tubular members for the frame 14, enables the unit 10 to utilize a portion of that hollow frame for storage of compressed air without the need for an additional storage tank. As shown in FIG. 1 air hose 80 extends from compressor 16 to an upper end of a chamber 82. The chamber 82 is defined by bulkheads 83 and 84 secured within hollow frame section 85. A pressure gauge 86 is shown disposed thereon for monitoring operation. This reduces expense as well as weight. By incorporating the limited capacity of the DC compressor to resupply the reservoir and the frame, a self-actuating sensor/trigger is thus feasible unlike assemblies utilizing more powerful compressors which require a separate timing circuit for actuation. The simplicity of the pneumatic assemblage is likewise manifest in the actuation arm 18 wherein the piston cylinder assembly is consistent with the basic frame design thereby utilizing a hollow cylindrical member with a solid piston arm disposed therein.

As set forth herein, the manufacture of the system 10 of the present invention is greatly simplified by the utilization of hollow tube PVC or the like. The frame 14 provides a structural base of the system 10 that is both structurally solid, lightweight in construction, weather resistant, and multi-functional, such as defining chamber 82. The utilization of hollow PVC tubular members 50 as defined herein provides means for assembly which overcomes numerous of the disadvantages of the prior art defined above. Repair, for example, is greatly facilitated because the average layman capable of replacing broken PVC sections simply by utilizing a hacksaw, suitable PVC cement and appropriate coupling sections. Unlike apparatus which is constructed of stainless steel tubing and the like that is damaged, the present invention can be repaired in one's garage with basic tools. This theory also forms the basis of other aspects of the present design wherein the pivotal system as well a pressurization system is basic in nature, reliable and repairable. The pivots as described herein, for example, generally can comprise conventional threaded members which may be replaced by standard bolts from hardware stores and the like. The return spring 35 may be of conventional construction for facilitating user repair. The period may thus be seen to be "user friendly" unlike many more sophisticated and more costly. In manufacture then, the hollow PVC tubular members 50 are constructed with the requisite bulkheads 83 and 84 to comprise a chamber 85 of suitable dimension for receiving the air from compressor 16 mounted directly to the frame 14. The air volume within the chamber 85 is monitored by the actuation trigger 30 by the simple pop-off valve 32 defined above. Likewise the piston in the actuation cylinder 18 can be constructed of wood or the like of a conventional dowel rod design for which tolerances are not of utmost concern. The reason is basic. Air pressure can be adjusted for variations for tolerance to achieve the desired pitching angle and the absence of sealing members increases longevity and reliability without the problem of deleterious wear. Moreover, the presence of rain or other moisture cannot damage the present system because it is basically a combination of plastic, wood and low voltage systems adapted for outdoor use. Since softball batting practice is generally dependent upon convenience and not the weather, such considerations are very important.

It is thus believed that the operation and construction of the present invention will be apparent from the foregoing description. While the method and apparatus shown and described has been characterized as being preferred, it will be obvious that various changes and modifications may be made therein without departing from the spirit and scope of the invention as defined in the following claims.

What is claimed is:

1. An improved system for hurling baseballs along a predefined arced trajectory of the type wherein a ball is hurled toward a batter, said improvement comprising:

a frame adapted for positioning upon a support surface;

an arm pivotally mounted to said frame and constructed for receiving a baseball on an end thereof for being hurled toward a batter;

means securable to said frame for supplying compressed air for pivotal actuation of said arm from a first rest position into an arced position;

a pneumatic cylinder coupled at a first end to said arm and at a second end to said frame and adapted for pivotally actuating said arm;

means coupling said compressed air means to said pneumatic cylinder for the actuation thereof;

a ball chute one end of which is disposed adjacent said arm and in close proximity to said end thereof constructed for receiving said baseball thereon in its rest position;

means for retaining and discharging balls from said ball chute upon said end of said arm prior to the pivotal actuation thereof to hurl said baseball toward said batter;

means for selectively actuating said pneumatic cylinder for hurling said balls positioned upon said pivotal arm by the pivotal actuation thereof from its rest position to its arced position in response to compressed air within said pneumatic cylinder; and a compression return chamber coupled to said pneumatic cylinder in flow communication therewith for receiving compressed air therefrom during the pivotal actuation of said arm and providing a return force to said arm to return it to its rest position from its arced position.

2. The apparatus of claim 1 wherein said actuation means comprises a pop off valve and pressure fluid valve, said pop off valve being adapted for discharging compressed air for actuating said pressure fluid valve in release of said compressed fluid into said pneumatic cylinder.

3. The apparatus as set forth in claim 1 wherein said ball chute comprises a cylindrical tube mounted to said frame and having a lower end disposed adjacent an upper end of said pivotal arm.

4. The apparatus as set forth in claim 1 wherein said means for supplying compressed air comprises a compressor mounted to said frame.

5. The apparatus as set forth in claim 4 wherein said compressor is powered by 12 volt DC current and further includes a power cord having at least one end adapted for electrical connection with an automotive vehicle.

6. The apparatus as set forth in claim 1 wherein said ball chute comprises a tube secured to said frame, having an upper end adapted for receipt of balls therein and a lower end disposed adjacent an upper end of said pivotal arm, and wherein means for retaining and discharging balls from said ball chute comprise means for retaining and discharging individual balls from said ball chute when a plurality of balls is disposed therein.

7. The apparatus as set forth in claim 6 wherein said means for discharging individual balls from said ball chute comprises a generally L-shaped trigger adapted for engaging and releasing individual balls within said ball chute.

8. The apparatus as set forth in claim 6 wherein said generally L-shaped trigger comprises a release arm extending outwardly from said chute and being pivotally attached thereto at a first end and being constructed for engaging said arm at a second end whereby the positioning of said arm thereon causes pivotal actuation of said generally L-shaped member.

9. The apparatus as set forth in claim 8 wherein said release arm further comprises a counterweight secured thereto adapted for applying a counterweight force for facilitating engagement of said arm with said release arm.

* * * * *